US007121848B2

(12) United States Patent
Ono

(10) Patent No.: US 7,121,848 B2
(45) Date of Patent: Oct. 17, 2006

(54) BATTERY CONNECTOR

(75) Inventor: Naoyuki Ono, Shinagawa-ku (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 11/023,305

(22) Filed: Dec. 22, 2004

(65) Prior Publication Data

US 2005/0142915 A1 Jun. 30, 2005

(30) Foreign Application Priority Data

Dec. 26, 2003 (JP) ..... 2003-433494

(51) Int. Cl.
*H01R 12/00* (2006.01)

(52) U.S. Cl. ..... 439/83; 439/682

(58) Field of Classification Search ..... 439/83, 439/876, 31, 660, 682, 171
See application file for complete search history.

(56) References Cited

U.S. PATENT DOCUMENTS 6,068,519 A * 5/2000 Lok ..... 439/660
6,244,883 B1 * 6/2001 Ito et al. ..... 439/247
6,439,934 B1 8/2002 Yu
6,551,143 B1 * 4/2003 Tanaka et al. ..... 439/682
6,702,621 B1 * 3/2004 Yeh ..... 439/660
2001/0021609 A1 * 9/2001 Chiang ..... 439/682
2002/0081915 A1 6/2002 Igarashi et al.

FOREIGN PATENT DOCUMENTS

JP 2711223 10/1997

* cited by examiner

*Primary Examiner*—Tulsidas C. Patel
*Assistant Examiner*—Vladimir Imas
(74) *Attorney, Agent, or Firm*—Pearne & Gordon LLP

(57) ABSTRACT

A connector includes: a housing that is provided with a fitting opening at a side to which a printed wiring board is to be opposed and a housing wall surface; and a contact member that is fitted inside the housing through the fitting opening, the contact member including a U-shaped spring body and a U-shaped fitting portion engageable with the housing wall surface. After the contact member is fitted inside the housing and the housing is arranged on the printed wiring board, a lower surface of the U-shaped fitting portion is opposed to the printed wiring board and formed as a soldering portion.

2 Claims, 4 Drawing Sheets

BATTERY CONNECTOR

BACKGROUND OF THE INVENTION

The present invention relates to a battery connector, and more particularly to a battery connector for a portable device which is used by being fixed to a printed wiring board (PWB) by soldering or the like.

A battery connector is generally used by being connected to a subject substrate incorporated in an electronic device mounted on a printed wiring board (PWB). Terminal ends are exposed from a housing of the battery connector, and soldering portions project therefrom in flat form.

A 3P battery connector P1, which is a battery connector of a first related art shown in FIGS. 7 and 8, has three contact members 101 constituted by U-shaped spring portions inside a housing 100. As shown in FIG. 8 illustrating a cross section taken along line B—B in FIG. 7, a rear-end extended portion of each contact member 101 is bent toward the rear in an L-shape in a cross-sectional view. The rearwardly bent portion is formed as a soldering portion 102, and the battery connector P1 is attached by soldering to a printed wiring board 3 by soldering by means of one surface of each of the soldering portions 102 (see Japanese Patent No. 2711223, for example).

Further, a 4P battery connector P2 which is a battery connector of a second related art shown in FIGS. 9 and 10 has a housing 200 and four contact members 201 constituted by U-shaped spring portions. A rear-end extended portion of each contact member 201 is formed as a soldering portion 202 projecting toward the printed wiring board 3, and is attached by being inserted in an attaching hole in the printed wiring board 3 at the time of attachment.

Furthermore, both the battery connector P1 of the first related art and the battery connector P2 of the second related art are structured such that openings for fitting the contact members at the time of assembly in a case where the contact members are fitted in the housing at the time of assembly are not open on the mounting side of the printed wiring board.

In the battery connector P1 in first related art, the soldering portion 102 having the L-shaped cross section on the rear side projects from the contact member 101 rearwardly of the housing 100, and partially covers a rear surface of the housing 100. For this reason, after the battery connector P1 is attached at the soldering portions 102 to the printed wiring board 3, it is necessary to cover the exposed portions of the soldering portions 102 with an insulating cover. Therefore, there has been a problem in that the procurement of those parts and the attaching operation are required. In addition, as for the housing 100, since the rear surface side for attaching the soldering portions 102 is open, the sealing performance of the housing interior has been low.

In addition, with the battery connector P1 of the first related art, since it has the soldering portions 102 projecting rearwardly of the housing 100, there has been a problem in that the battery connector P1 cannot be made further compact. There has been another problem in that at the time of soldering the soldering portion 102 and the printed wiring board 3, amounting offset occurs due to the surface tension of the solder. Similarly, the battery pack disclosed in patent document 1 also has problems similar to those of the first related art.

With the battery connector P2 of the conventional technique 2 as well, in the same way as the battery connector P1, since it has the soldering portions 202 projecting from the housing 200 toward the printed wiring board 3, after the soldering portions 202 are attached to the printed wiring board 3, it is necessary to cover the exposed soldering portions 202 with an insulating cover. Therefore, there has been a problem in that the procurement of those parts and the attaching operation are required.

In addition, with the battery connectors P1 and P2 of the first and second related arts, the openings for fitting the contact members at the time of assembly in a case where the contact members are fitted in the housing at the time of assembly are not open in a direction toward the printed wiring board side. Therefore, the sealing performance of the housing after mounting on the printed wiring board is low. Hence, there has been a problem in that dust, a liquid, or the like can enter the housing interior, and a fault is likely to occur.

SUMMARY OF THE INVENTION

In view of above, an object of the present invention is to improve the performance of the connector.

In order to solve the aforesaid object, the invention is characterized by having the following arrangement.

(1) A connector comprising:

a housing that is provided with a fitting opening at a side to which a printed wiring board is to be opposed and a housing wall surface; and a contact member that is fitted inside the housing through the fitting opening, the contact member including a U-shaped spring body and a U-shaped fitting portion engageable with the housing wall surface, wherein after the contact member is fitted inside the housing and the housing is arranged on the printed wiring board, a lower surface of the U-shaped fitting portion is opposed to the printed wiring board and formed as a soldering portion.

(2) The connector according to (1) further comprising a protective wall defining a soldering space so as to oppose a part of the soldering portion which is located inside the housing.

(3) The connector according to (2), wherein the housing and the protective wall are integrally formed.

(4) The connector according to (1), wherein the U-shaped fitting portion includes a base portion that is connected to the spring body and elongated downwardly toward the printed wiring board, a flat portion connected to the base portion and elongated laterally and an upward end portion connected to the flat portion, the housing wall surface oriented downwardly is inserted between the base portion and the upward end portion.

(5) The connector according to (4), wherein the U-shaped fitting portion includes curved surface portions that are formed between the base portion and the flat portion and between the flat portion and the upward end portion and constitute the soldering portion.

According to the invention, the soldering portion for mounting on the printed wiring board can be made smaller as compared with the conventional art, and it becomes possible to make the battery connector compact.

In addition, according to the invention, the soldering portion is an outer surface on each side of a lower portion of the U-shape. Therefore, fillets which are formed by the surface tension at the time of the melting of solder are formed at two portions of the U-shape. Hence, even if the soldering area is small, satisfactory soldering strength is provided, and a self-alignment effect at the time of soldering is provided.

Furthermore, after the mounting on the printed wiring board, since the exposed portions of the soldered portions are extremely small, an insulating cover becomes unnecessary. Therefore, the procurement of such parts and the attaching operation are not required, so that the manufacturing efficiency improves.

In addition, the openings for fitting the contact members at the time of assembly in a case where the contact members are fitted in the housing at the time of assembly are open in a direction toward the printed wiring board side. Therefore, the sealing performance of the housing after mounting on the printed wiring board improves. Hence, the possibility of dust, a liquid, or the like entering the housing interior and causing a fault declines.

DETAILED DESCRIPTION OF PREFERRED EMBODIMENTS

Figure 1:
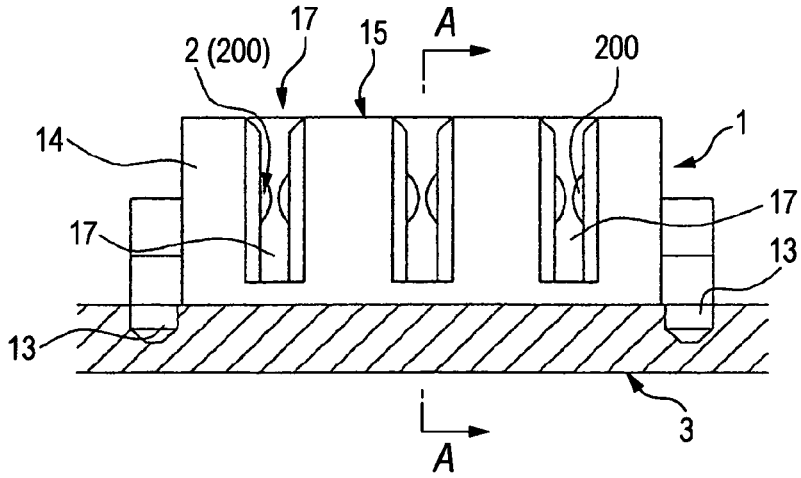
FIG. 1 is a front elevational view illustrating an embodiment of a battery connector in accordance with the invention.
Figure 2:
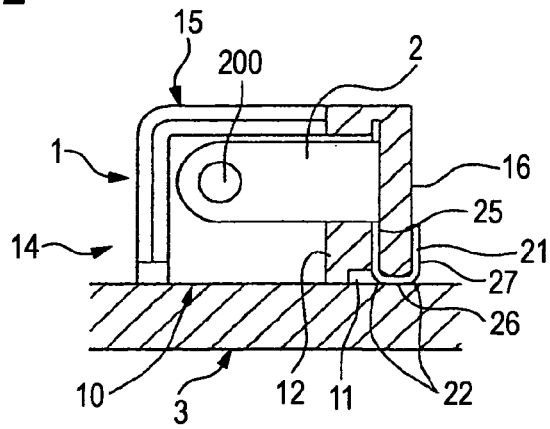
FIG. 2 is a cross-sectional view taken along line A—A in FIG. 1.
Figure 3:
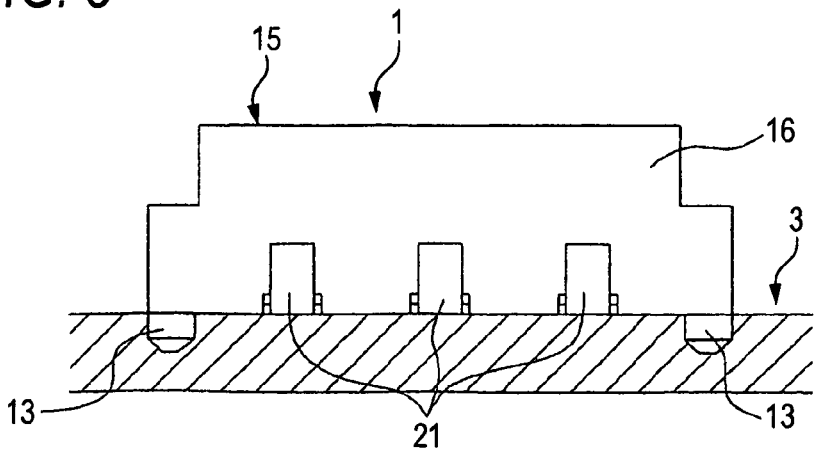
FIG. 3 is a rear view illustrating the embodiment of the battery connector in accordance with the invention.
Figure 4:
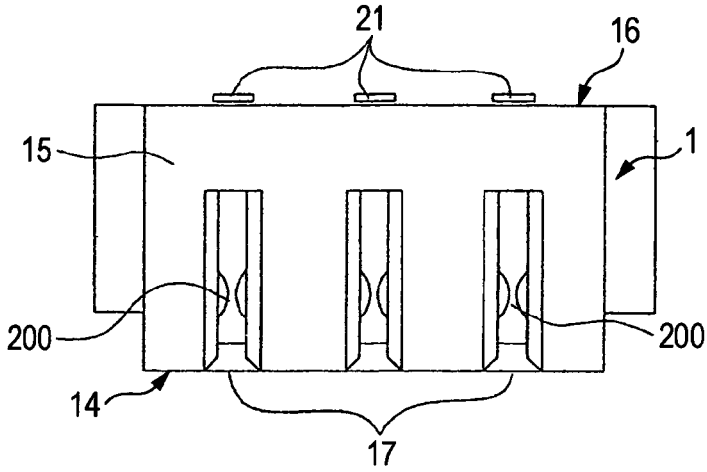
FIG. 4 is a plan view illustrating the embodiment of the battery connector in accordance with the invention.
Figure 5:
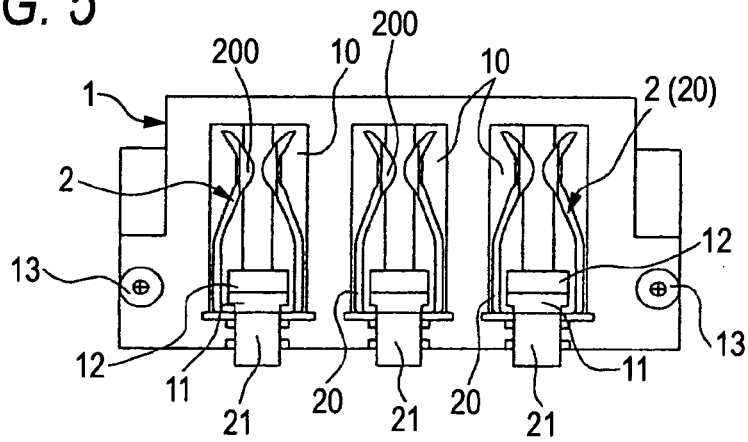
FIG. 5 is a bottom view illustrating the embodiment of the battery connector in accordance with the invention.
Figure 6:
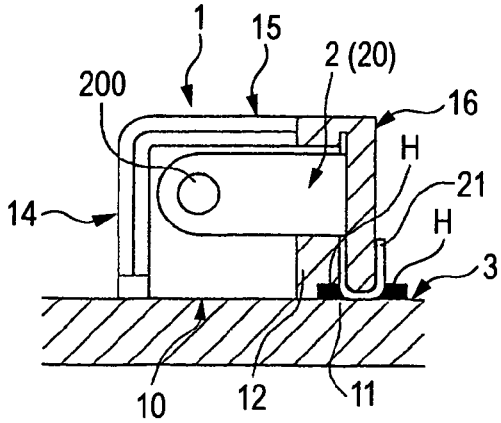
FIG. 6 is an explanatory diagram illustrating a state in which soldering is provided in a cross-sectional view taken along line A—A in FIG. 1.
Figure 7:
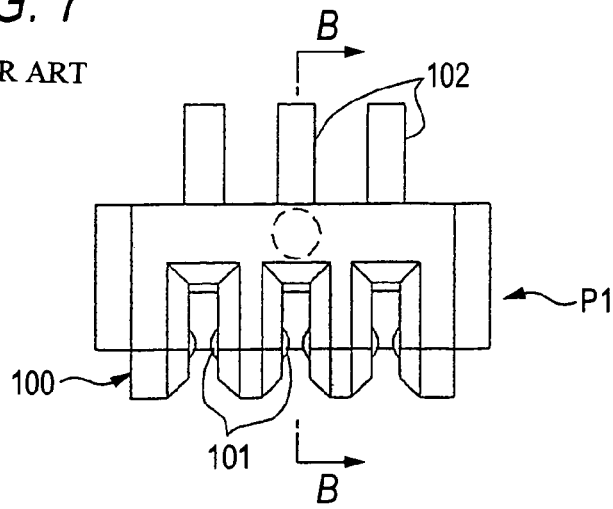
FIG. 7 PRIOR ART
FIG. 7 is a plan view of a battery connector of a first related art.
Figure 8:
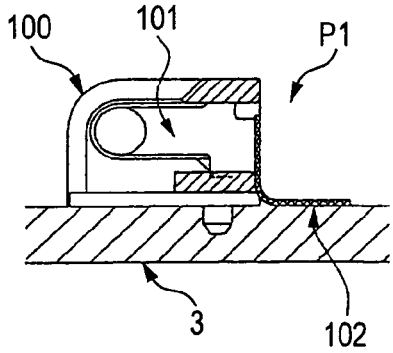
FIG. 8 PRIOR ART
FIG. 8 illustrates the conventional technique 1 and is a cross-sectional view taken along line B—B in FIG. 7.
Figure 9:
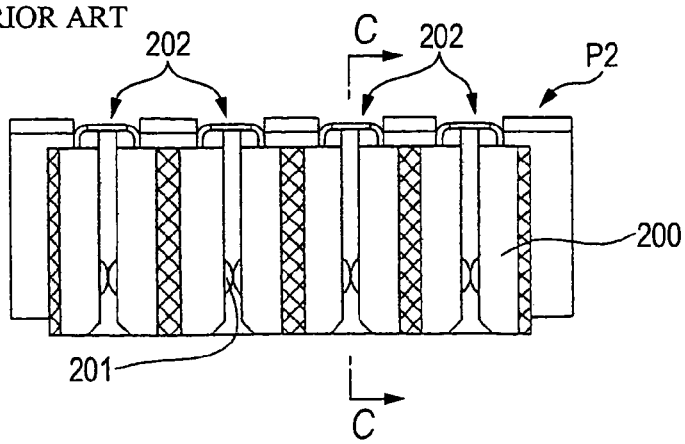
FIG. 9 PRIOR ART
FIG. 9 is a plan view of a battery connector of a second related art.
Figure 10:
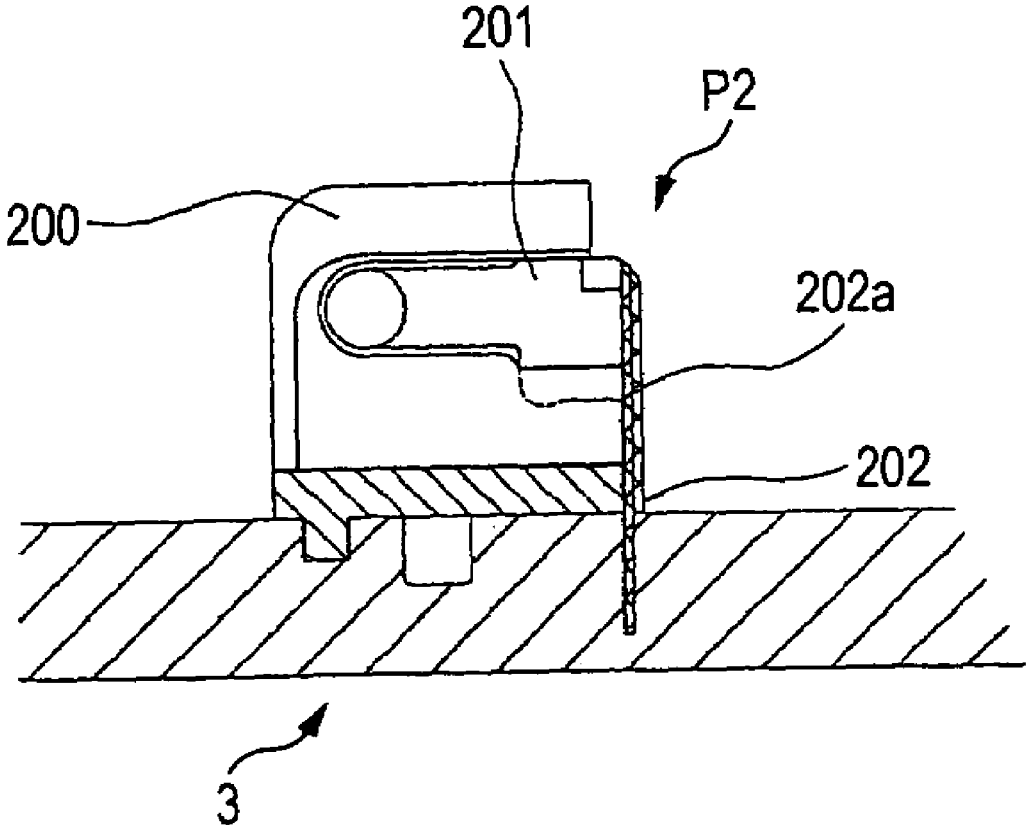
FIG. 10 PRIOR ART
FIG. 10 illustrates the conventional technique 2 and is a cross-sectional view taken along line C—C in FIG. 9.

Referring to FIGS. 1 to 6 illustrating an embodiment of the invention, a description will be given of a battery connector of the invention. FIG. 1 is a front elevational view of the battery connector; FIG. 2 is a cross-sectional view taken along line A—A in FIG. 1; FIG. 3 is a rear view of the battery connector; FIG. 4 is a plan view of the battery connector; FIG. 5 is a bottom view of the battery connector; and FIG. 6 is an explanatory diagram illustrating a state in which soldering is provided in a cross-sectional view taken along line A—A in FIG. 1.

The battery connector in accordance with the embodiment of the invention is comprised of a housing 1 and contact members 2, and is mounted on a printed wiring board 3 by soldering.

In the housing 1, fitting openings 10 that are opened at the time of assembling contact members are formed on its side for mounting on the printed wiring board 3, i.e., on its printed-wiring-board mounting side. The contact members 2 are fitted in the housing 1 through these opening openings 10 for fitting before they are mounted on the printed wiring board 3. Openings 17 for contacts which continue to a front wall surface 14 and an upper wall surface 15 are provided in the housing 1. In this embodiment, since the battery connector is a 3P battery connector, three contact members 2 are fitted such that opposing contact projections 20 of the contact members 2 are respectively located in the three openings 17 for contacts.

In addition, the housing 1 is integrally provided with protective walls 12 each having a soldering space 11 so as to oppose a lower surface of one flat plate portion of the U-shape, which is located inside the housing, of a U-shaped fitting portion 21 of the contact member 2 which will be described later. Reference numeral 13 is a positioning projection for positioning at the time of mounting on the printed wiring board 3, and projects downward from each of left and right side end portions of the housing 1.

The contact member 2 has a spring body 20 which is U-shaped in a plan view of a bottom view, as well as the U-shaped fitting portion 21 which is a member continuing rearwardly from the rear surface side of this spring body 20 and is engageable with a wall surface 16 on the rear surface side of the housing. The U-shaped spring body 20 has a pair of opposing contact projections 200 for clamping from both sides and contacting a contact plate member (not shown), which is inserted through the opening 17 for the contact, by means of a pair of leaf springs.

The U-shaped fitting portion 21 is fixed at its one flat plate portion of the U-shape to a rear surface portion of the spring body 20, and is engaged at a groove portion of the U-shape with the housing rear wall surface 16 from its lower end side, to thereby fit the contact member 2 to the housing 1. Specifically, the U-shaped fitting portion 21 includes a base portion 25 elongated downwardly (vertically) from the spring body 2 toward the printed wiring board, a flat portion 26 elongated laterally rearwardly and an upward end portion 27 elongated upwardly, which are defines the groove portion. The housing rear wall surface 16 is inserted between the base portion 25 and the flat portion 26. Two curved outer surface portions on the front and rear sides of a lower surface of the U-shaped fitting portion 21 are formed as soldering portions 22. That is, the one of the curved outer surface portions is formed between the base portion 25 and the flat portion 26 and the other is formed between the flat portion 26 and the upward end portion 27.

Next, a description will be given of the operation in which the 3P battery connector in accordance with the embodiment of the invention is mounted on the mounting surface of the printed wiring board 3, as well as its action. As for the battery connector, the contact members 2 are fitted in the interior of the housing 1 through the fitting openings 10. At this time, each U-shaped fitting portion 21 is engaged with the lower end of the housing rear wall surface 16 in such a manner as to clamp it by its U-groove. The contact projections 200 of each contact member 2 are provided at positions where they can be viewed through the openings 17 for contacts.

Next, this battery connector is positioned by orienting the opening 10 side of the housing 1 toward the mounting surface of the printed wiring board 3 and by causing the positioning projections 13 to correspond to recesses in the printed wiring board 3.

In this state, the lower surface of each U-shaped fitting portion 21 is opposed to the printed wiring board 3 and is in contact with the mounting surface of the printed wiring board 3 in this embodiment, but may be in a state of opposing it with a slight interval therebetween. Soldering is effected such that, as shown in FIG. 6, solder H is positioned at the soldering portions 22 which are the two curved surface portions on the front and rear sides of the lower surface of the U-shaped fitting portion 21, and the solder H, when melted, comes into contact with both the mounting surface of the printed wiring board 3 and the soldering portion 22. Then, a temperature for melting the solder H is imparted in a particular apparatus, and the solder H is subsequently allowed to cool and solidify, thereby fixing the battery connector to the surface of the printed wiring board 3.

At this time, since the soldering space 11 is present at the soldering portion 22 in the lower portion of one flat plate portion of the U-shape, which is located inside the housing, of the U-shaped fitting portion 21, the solder is stably positioned in this space. At the same time, since the protective wall 12 is provided on the housing interior side of this space 11, it is possible to prevent the scattering of the molten solder to the housing interior due to the flux gas generated on heating and when the solder melts.

The invention makes it possible to make further compact the battery connector for a portable device such as a portable telephone for which a compact size is desirable, and makes it possible to reduce an area for mounting on the printed wiring board (PWB). Hence, its utility as a battery connector for a portable device is high.

What is claimed is:

1. A connector comprising:

a housing that is provided with a fitting opening at a side to which a printed wiring board is to be opposed and a housing wall surface; and a contact member that is fitted inside the housing through the fitting opening, the contact member including a U-shaped spring body and a U-shaped fitting portion engageable with the housing wall surface, wherein after the contact member is fitted inside the housing and the housing is arranged on the printed wiring board, a lower surface of the U-shaped fitting portion is opposed to the printed wiring board and formed as a soldering portion, and wherein the U-shaped fitting portion includes a base portion that is connected to the spring body and elongated downwardly toward the printed wiring board, a flat portion connected to the base portion and elongated laterally and an upward end portion connected to the flat portion, the housing wall surface oriented downwardly is inserted between the base portion and the upward end portion.

2. The connector according to claim 1, wherein the U-shaped fitting portion includes curved surface portions that are formed between the base portion and the flat portion and between the flat portion and the upward end portion and constitute the soldering portion.

* * * * *